US007887651B1

(12) United States Patent
Mahe

(10) Patent No.: US 7,887,651 B1
(45) Date of Patent: Feb. 15, 2011

(54) SEMI-CONTINUOUS TWO-COMPONENT METHOD FOR OBTAINING A COMPOSITE EXPLOSIVE CHARGE WITH POLYURETHANE MATRIX

(75) Inventor: Bernard Mahe, Le Thor (FR)

(73) Assignee: Eurenco, Paris (FR)

( * ) Notice: Subject to any disclaimer, the term of this patent is extended or adjusted under 35 U.S.C. 154(b) by 1125 days.

(21) Appl. No.: 11/600,770

(22) Filed: Nov. 17, 2006

(30) Foreign Application Priority Data

Nov. 24, 2005 (FR) ..... 05 11892

(51) Int. Cl.
*D03D 23/00* (2006.01)

(52) U.S. Cl. ..... 149/109.6; 149/19.92

(58) Field of Classification Search ..... 149/109.6, 149/19.92; 264/3.1, 3.4
See application file for complete search history.

(56) References Cited

U.S. PATENT DOCUMENTS

| | | | | |
|---|---|---|---|---|
| 4,191,480 | A | 3/1980 | Hiorth | |
| 4,632,715 | A * | 12/1986 | Curtis | 149/19.5 |
| 4,657,607 | A | 4/1987 | Perotto et al. | |
| 5,085,717 | A * | 2/1992 | Berard et al. | 149/19.9 |
| 5,114,630 | A * | 5/1992 | Newman et al. | 264/3.1 |
| 5,529,212 | A | 6/1996 | Terhardt | |
| 5,739,252 | A * | 4/1998 | Kirchmeyer et al. | 528/59 |
| 6,036,894 | A | 3/2000 | Brown et al. | |
| 2005/0115652 | A1 | 6/2005 | Augier et al. | |
| 2005/0188824 | A1 | 9/2005 | Pressley | |

FOREIGN PATENT DOCUMENTS

| | | | |
|---|---|---|---|
| DE | 41 15 201 | A1 | 1/1992 |
| EP | 0 194 180 | A1 | 9/1986 |
| EP | 1 333 015 | A2 | 8/2003 |
| FR | 2 746 389 | | 9/1997 |
| WO | WO 92/22377 | | 12/1992 |
| WO | WO 03/078356 | A1 | 9/2003 |

OTHER PUBLICATIONS

J. Quinchon et al., "Poudres, Propergols et Explosifs", vol. 1, Les Explosifs, Techniques and Documentation, 1982, pp. 190-192.

J. M. Tauzia, "Some Comments on Processing Energetic Materials", American Defense Preparedness Symposium on Compatibility and Processing, Oct. 25-26, 1989.

* cited by examiner

*Primary Examiner*—Aileen Felton
(74) *Attorney, Agent, or Firm*—Oliff & Berridge, PLC

(57) ABSTRACT

The present invention relates to a semi-continuous method for obtaining a composite explosive charge comprising a solid polyurethane matrix loaded with a charge, the charge being in powder form and comprising at least one nitro-organic explosive. The said method comprises the following successive steps:

the obtaining of a pasty explosive composition comprising essentially the following ingredients:
- a polyol pre-polymer,
- a polyisocycanate monomer,
- a plasticising agent, and
- a solid charge in powder form comprising at least one nitro-organic explosive, by continuous mixing of a pasty component A' and a liquid component prepared discontinuously from the said constituent ingredients, the introduction into a mould of the said pasty explosive composition, and the thermal cross-linking of the said composition in the said mould, and being characterised in that:

the said liquid component B' comprises 90 to 99% by weight of the said polyisocyanate monomer;

the said pasty component A' comprises the whole of the polyol pre-polymer, the whole of the solid charge in powder form and the remaining 1 to 10% by weight of the polyisocyanate monomer, the plasticising agent being distributed without distinction between the said components A' and B', and in that the continuous mixing of the said components A' and B' is carried out in such a way that the weight ratio between component A'/component B' is constant, being between 95.05/4.95 and 99.55/0.45.

The said method constitutes a particularly interesting improvement of the method according to EP-A-1 133 015.

11 Claims, No Drawings

SEMI-CONTINUOUS TWO-COMPONENT METHOD FOR OBTAINING A COMPOSITE EXPLOSIVE CHARGE WITH POLYURETHANE MATRIX

The present invention falls within the military domain, more particularly within that of explosive munitions, such as bombs and shells.

More precisely, it relates to a new method for obtaining composite explosive charges with a solid polyurethane matrix.

The term "composite explosive" is understood in the traditional sense to mean a functionally detonatable pyrotechnic composition comprising a solid polymer matrix, in general polyurethane, loaded with a charge, the said charge being in powder form and containing a nitro-organic explosive charge, such as hexogen, octogen, ONTA (oxynitrotriazole), or a mixture of at least two of these components.

Composite explosive charges and the way of obtaining them are described, for example, by J. QUINCHON, "Poudres, Propergols et Explosifs" [Powders, Propellants, and Explosives], Volume 1, Les explosifs [Explosives], Techniques and Documentation, 1982, pages 190-192". The charge in powder form is mixed in a mixer with a liquid polymerisable resin, such as a pre-polymer with hydroxyl endings. A paste is obtained which can be poured into a mould and then polymerised by heat-curing. By the choice and adjustment of the resin cross-linking agents, catalysts, and other additives, moulded pieces of varying characteristics can be obtained.

This traditional method of mixing all the constituents which are introduced and mixed in a mixer according to a defined sequence presents disadvantages and limitations.

When the mixture is obtained, the paste must be used within a fairly brief period of time (pot life). The extension of the pot life by reducing the proportion of cross-linking catalyst is offset by an increased polymerisation duration, the temperature being limited, among other factors, by the pyrotechnic nature of certain constituents.

To operate in this way accordingly necessitates a technical compromise between the pot life and the duration of heat-curing, as well as an obligatory linking of the sequences of mixing and moulding of the paste.

It likewise necessitates a compromise in economic terms between the size of the mixer and the size of the moulded object.

In fact, while this "batch" method has proved to be reasonably well-suited for the manufacture of large objects such as underwater mines, torpedoes, and bombs, it has, conversely, proved to be highly cumbersome and costly in the manufacture of a large number of small moulded objects at a high production rate, such as in the manufacture of several hundreds of shells of a diameter of the order of 50 to 100 mm, each containing from several hundred grams to several kilos of composite explosive, from a mixture of 1 to 3 tonnes of paste.

It is necessary in this situation to have a high pot life in order for a considerable number of munitions to be charged with the same mixture, which is offset by a particularly long cross-linking duration of the paste and a very high cost of the manufacturing cycle due to the duration of immobilisation of equipment and personnel.

If the size of the mixer is reduced, the number of munitions to be filled per mixture is reduced, which is penalising economically.

The person skilled in the art has tried to break this circle of pot life/heat-curing duration, and this obligatory and precise sequencing of the mixing and moulding operations.

J. M. TAUZIA, in a communication entitled "Some comments on Processing Energetic Materials" at the "Compatibility and Processing" symposium organized by the American Defense Preparedness Association (ADPA) on 23-25 Oct. 1989 at Virginia Beach (United States) suggested, to resolve this problem, a two-component method in which two chemically stable polymeric components presenting approximately the same proportion of charge and the same viscosity are first produced, from the constituents, discontinuously in mixers.

These two paste components are then mixed continuously with a mass ratio of close to 1.

This two-component method, while indeed easing the pot life/heat-curing duration compromise and making it possible for the two components to be stored for several weeks, does present several disadvantages.

A first disadvantage is that it has proved a very delicate procedure to mix the two paste components continuously in order to obtain a homogenous product.

A second disadvantage is that the two components are pyrotechnically active (presence of explosive charges), and both components must therefore be manufactured and then stored in secure installations.

A third disadvantage is that the solid polymer matrix of the composite explosive finally obtained is different from that which is obtained with the same constituents in the same proportions according to the traditional "batch" process. In fact, according to J. M. TAUZIA, the isocyanate component is polymeric. The fact of preparing, as an intermediate, an isocyanate pre-polymer from the initial isocyanate monomer results in the obtaining of a solid polyurethane matrix which is different from that obtained by the "batch" process, mixing directly all of the isocyanate monomer and all the hydroxyl pre-polymer.

This difference in structure of the solid polyurethane matrix incurs undesirable differences in the mechanical and/or detonation properties, which therefore necessitates a very expensive and laborious requalification of the final product.

The two-component method described by J. M. TAUZIA is, therefore, not totally satisfactory.

Methods of manufacture are also known for propellants (and not for explosive charges) based on extrusion. The method according to patent application FR 2 746 389 comprises a two-step polymerisation process:

- a first step which involves the introduction of a first quantity of the cross-linking agent (about 70% by weight) to obtain a visco-elastic product,
- a second step which involves the introduction of the complementary quantity of the cross-linking agent (about 30% by weight) to obtain a rubbery product.

In such a context, different from that of the invention (the man skilled in the art understands that the mixer described would not be appropriate for the treatment of explosive molecules), the cross-linking agent is used twice, in order to implement the polymerisation in two steps. It is used in a significant quantity for the implementation of the first of the said two steps, and in a larger quantity for the implementation of the said first of the said two steps than for the implementation of the second of the said two steps.

In such a context, the Applicant has already proposed a method of improving the previously mentioned two-component method. The Applicant proposed a semi-continuous two-component method of obtaining a composite explosive charge with a polyurethane matrix, which has neither the disadvantages of the traditional "batch" method nor the aforesaid disadvantages of the two-component semi-continuous method described by J. M. TAUZIA. The said method has in particular been described in patent application EP-A-1 333 015. It has, in combination, two original technical features, one relating to the distribution of the constituents in the two components, the other relating to the weight ratio of the mixture of the said two components.

The said method is a semi-continuous method for obtaining a composite explosive charge comprising a solid polyurethane matrix, loaded with a charge, the said charge being solid and in powder form and comprising at least one nitro-organic explosive, by the introduction into a mould of a pasty explosive composition, then thermal cross-linking, the said composition being obtained by mixing constituents comprising essentially a polyol pre-polymer, a polyisocyanate monomer, a plasticising agent, and a solid charge in powder form comprising at least one nitro-organic explosive. It is characterised in that, in order to obtain the pasty explosive composition:

firstly, in a discontinuous way and from all of the constituents, two components are produced by simple homogenous mixing:

a pasty component A, comprising the whole of the polyol pre-polymer and the whole of the solid charge in powder form, a liquid component B, comprising the whole of the polyisocyanate monomer, the plasticising agent being distributed without distinction between the two components A and B, next, the component A and the component B are mixed continuously in such a way that the weight ratio of component A to component B is constant, being between 95/5 and 99.5/0.5.

It is important to note the two technical features of this method:

the fact that the components A and B are not of the same viscosity, that one is pasty and comprises the whole of the charge and the polyol pre-polymer, and the other is liquid and comprises the whole of the polyisocyanate monomer, and this without chemical modification, in particular without any pre-polymerisation with the aid of a polyol; and the weight ratio of component A to component B is very specific.

This combination of distinctive technical features, compared to the two-component semi-continuous method according to J. M. TAUZIA, has the technical effect of eliminating all the previously mentioned disadvantages and rendering the method particularly simple and economical.

Only the component A is pyrotechnically active, which considerably reduces the safety constraints, and the mixture of the components A and B is easily rendered homogenous.

In addition to this, the physico-chemical, mechanical, detonating and vulnerability properties of the final product are identical to those of the product obtained using the traditional "batch" method, based on the same constituents in the same proportions, which avoids a detrimental requalification of the product.

The operations of preparing the components A and B are totally independent of the operations of mixing the components A and B and of moulding them, and can be carried out during downtimes. These components A and B can be stored if required for several weeks before being mixed.

The method according to EP-A-1 333 015 is, in addition, totally independent of the pot life due to the fact that mixing of small quantities of the components A and B takes place rapidly and continuously, which allows for the percentage of the cross-linking catalyst to be increased, and in consequence for the duration of cross-linking of the pasty explosive component in the mould to be reduced, and/or for this cross-linking to be carried out at a lower temperature.

Cross-linking at ambient temperature (20° C.) is even possible, which can be particularly advantageous.

To implement the said method according to EP-A-1 333 015, a genuine difficulty is sometimes encountered with regard to the feeding of the mixer (component A/component B, located upstream of the mould) with the component A. This component is, in fact, introduced into the said mixer, generally static, under the pressure of a piston, and the level of pressure necessary to set the piston in motion is plainly proportional to the pressure loss, this being more substantial the higher the viscosity of the said component A. The said component A has, in certain cases, a high viscosity, due to the fact that it comprises little liquid.

With reference to this technical difficulty, the Applicant presently proposes an improvement to the said method according to EP-A-1 333 015. The Applicant proposes, in fact, the incorporation of a small quantity of polyisocyanate monomer (component B) into component A.

The Applicant has demonstrated, surprisingly, that such an incorporation—of a small quantity of polyisocyanate monomer (often categorised as the cross-linking agent) in the component A—allows for the reduction in an extremely significant manner of the viscosity of the said component A.

The small amount at issue does not cause the cross-linking to start and therefore does not have an effect on the duration of preservation of the component A, but, in an entirely unexpected manner, does exert an effect, of remarkable intensity, on the viscosity of the component A. This effect is much more than a simple dilution effect (of a paste by a liquid), since it is of a much greater intensity than that (insignificant) resulting from the addition of an equivalent quantity of another liquid such as the polyol pre-polymer or the plasticising agent or that which results, before any start of cross-linking, from the addition of the whole of the liquid polyisocyanate polymer. It would seem that, within the component A, the polyisocyanate monomer added acts as a surface-active agent, and that it modifies, in spectacular manner, the bonds between the binder (the matrix) and the charge.

It is now proposed that the method according to the invention is described, which accordingly constitutes an improvement of the method according to EP-A-1 333 015, and, in order to avoid any confusion in the description which follows, reference will be to component A' (paste) and B' (liquid).

The present invention, therefore, concerns a semi-continuous method of obtaining a composite explosive charge comprising a solid polyurethane matrix, loaded with a charge, the charge being in powder form and comprising at least one nitro-organic explosive, said method comprising the following successive steps:

the obtaining of a pasty explosive composition comprising essentially the following ingredients:

a polyol pre-polymer, a polyisocyanate monomer, a plasticising agent, and a solid charge in powder form, comprising at least one nitro-organic explosive, by continuous mixing of a pasty component A' and a liquid component B', prepared discontinuously from the said constituent ingredients;

the introduction into a mould of the said pasty explosive composition, and the thermal cross-linking of the said composition in the said mould.

In this, the said method is a method according to EP-A-1 333 015.

In this context, in a characterising way:

the said liquid component B' comprises 90 to 99% by weight of the said polyisocyanate monomer;

the said pasty component A' comprises the whole of the polyol pre-polymer, the whole of the solid charge in powder form and the remaining 1 to 10% by weight of the polyisocyanate monomer, the plasticising agent being distributed without distinction between the said components A' and B'; and the continuous mixing of the said components A' and B' is carried out in such a way that the weight ratio of component A' to component B' is constant (to within industrial standards of accuracy), being between 95.05/4.95 and 99.55/0.45.

According to the invention, in a characterising way, the pasty component comprises from 1 to 10% by weight, advantageously from 3 to 7% by weight, of the total quantity of the polyisocyanate monomer involved (the cross-linking agent). If it comprises less than 1% by weight, the effect on the viscosity is scarcely perceptible; if it comprises more than 10% by weight, the cross-linking is liable to commence inside it.

As explained previously, the method according to the invention reproduces the features of the method according to EP-A-1 333 015 with the "transfer" of a small amount of the polyisocyanate monomer of component B (having become B') to the component A (having become A'). The resultant effect of this "transfer" on the viscosity of said component A' is enormous (see the examples below). In terms of the method, this represents a considerable advantage. It allows for the obtaining of moulding flows which are substantially increased while having the same level of pressure in the installation. The person skilled in the art will clearly appreciate the interest of the improvement according to the invention.

It is now proposed that some greater detail be provided, in an entirely non-limitating manner, about the framework of the present invention (a framework which is understood to correspond to that of the invention according to EP-A-1 333 015).

At the time of the implementation of the method according to the invention, the pasty explosive composition is obtained on the basis of the usual constituents or ingredients used in accordance with previous methods and which are well known to the person skilled in the art.

These constituents comprise essentially a polyol pre-polymer, a polyisocyanate monomer, a plasticising agent, and a charge in powder form comprising at least one nitro-organic explosive.

The term "essentially" is understood to mean that the constituents or ingredients are always present and overall represent more than 90% by weight in relation to the total weight of the pasty explosive composition.

In a preferred manner, the sum total of the weight contents of polyol pre-polymer, polyisocyanate monomer, plasticising agent, and solid charge in powder form represents between 98% and 100% of the whole of the constituents.

In a general manner, the physical states, solid, liquid, or pasty of the constituents and compositions should be understood, in the present description, as being physical states at ambient temperature (about 20° C.) and at atmospheric pressure (about 0.1 MPa).

Traditionally, the term "nitro-organic explosive" is understood to mean an explosive chosen from the group consisting of the nitroaromatic explosives (comprising at least one C—$NO_2$ group, the carbon atom forming part of an aromatic cycle), the nitric ester explosives (comprising at least one C—O—$NO_2$ group) and the nitramine explosives (comprising at least one C—N—$NO_2$ group).

In a preferred manner, the nitro-organic explosive is chosen from the group consisting of hexogen, octogen, pentrite, oxynitrotriazole (ONTA), triaminotrinitrobenzene, nitroguanidine, and mixtures thereof, i.e. all the mixtures of at least two of the aforesaid compounds. In a particularly preferred manner, the nitro-organic explosive is chosen from the group comprising hexogen, octogen, ONTA, and mixtures thereof.

According to a preferred variant, the content of nitro-organic explosive is between 15% and 90% by weight in relation to the composite explosive, and the content of solid charge in powder form is between 75% and 90% by weight in relation to the composite explosive.

According to one variant, the solid charge in powder form only consists of at least one nitro-organic explosive.

According to another variant, the solid charge in powder form likewise comprises at least one other component than the at least one nitro-organic explosive.

It may comprise, for example, a reducing metal, preferably chosen from the group comprising aluminium, zirconium, magnesium, tungsten, boron and mixtures thereof. In a particularly preferred manner, the reducing metal present is aluminium. The content of reducing metal can be comprised, for example, between 2% and 35% by weight in relation to the composite explosive.

The charge in powder form can also comprise, in association or not with a reducing metal, a mineral oxidant, preferably chosen from the group comprising ammonium perchlorate, which is particularly preferred, potassium perchlorate, ammonium nitrate, sodium nitrate, and mixtures thereof. The content of mineral oxidant can be comprised, for example, between 10% and 45% by weight in relation to the composite explosive.

When the solid charge in powder form comprises at least one compound other than the nitro-organic explosive, this other compound is preferably chosen from the group consisting of ammonium perchlorate, aluminium, and mixtures thereof.

The polyol pre-polymer is a more or less viscous liquid. Its number-average molecular mass (Mn) is preferably between 500 and 10,000 and it is preferably chosen from the group consisting of the polyol polyisobutylenes, the polyol polybutadienes, the polyol polyethers, the polyol polyesters, and the polyol polysiloxanes. Use is made in a particularly preferred manner of a polybutadiene with hydroxyl endings.

The polyisocyanate monomer is traditionally a liquid, preferably chosen from the group consisting of toluene diisocyanate (TDI), isophorone diisocyanate (IPDI), dicyclohexylmethylene diisocyanate (MDCI), hexamethylene diisocyanate (HMDI), biuret trihexane isocyanate (BTHI), 3,5,5-trimethyl-1,6-hexamethylene diisocyanate, and mixtures thereof. In a particularly preferred manner, IPDI or MDCI are used.

The plasticising agent is also a liquid, preferably a monoester, such as isodecyl pelargonate (IDP), or a polyester chosen from the group consisting of the phthalates, the adipates, the azelates and the acetates. Among the polyesters, triacetin, the alkyl phthalates such as dioctyl phthalate (DOP), the alkyl azelates such as dioctyl azelate (DOZ) and the alkyl adipates such as dioctyl adipate (DOA), are particularly preferred.

Apart from the essential constituents cited previously, the body of constituents can also comprise at least one additive chosen from the group comprising the cross-linking catalysts (NCO/OH reaction catalysts), the wetting agents, the antioxidant agents, the binder-charge adhesion agents and the chain-extending compounds.

As a cross-linking catalyst, use is made for preference of dibutyl tin dilaurate (DBTL), but use can also be made of any other catalyst well known to the person skilled in the art, in particular of other organic compounds of tin such as a stannous salt of a carboxylic acid, a trialkyl tin oxide, a dialkyl tin dihalide, or a dialkyl tin oxide. Mention may be made, for example, of dibutyl tin diacetate, diethyl tin diacetate, dioctyl tin dioxide and stannous octoate. Use can also be made of a tertiary amine as a catalyst, in particular a trialkyl amine, or an organic compound of bismuth, such as triphenyl bismuth.

As a wetting agent, use is preferably made of a lecithin such as soybean lecithin or a siloxane.

As an antioxidant agent, use is preferably made of ditertiobutylparacresol (DBPC) or 2,2'-methylene-bis-4-methyl-6-tertiobutylphenol (AO02246).

As a binder-charge adhesion agent, use is preferably made of triethylene pentamine acrylonitrile (TEPAN), or certain compounds derived from silanols such as triethoxysilyl-3-propylsuccinic anhydride ($C_{13}H_{24}O_6Si$).

The said at least one additive chosen from among the cross-linking catalysts, the wetting agents, the antioxidant agents and the binder-charge adhesion agents can be distributed without distinction between the two components A' and B'. Preferably, it is totally contained in the component A'.

As the chain-extending compound (in the present case the polyurethane polymer chain), which is equally classified as the bridging agent, use is made in general of a polyol monomer of low weight, less than approx. 300, preferably a triol such as trimethyloipropane (TMP) or a diol such as dipropylene glycol. The said compound is mandatorily included in its entirety in the component A'.

According to an advantageous variant, apart from the principal ingredients (the polyol pre-polymer, the polyisocyanate monomer, the plasticising agent and the solid charge in powder form), the pasty explosive composition only includes at least one additional constituent ingredient, chosen from among the additives listed above.

Within the framework of the preferred variant embodiments:

- the component A' comprises the whole of the plasticising agent; and/or
- the component B' comprises solely the 90 to 99% by weight of the polyisocyanate monomer involved.

The components A' and B' are prepared independently, and discontinuously, by simple homogenous mixing, for example in a mixer, and are chemically stable; i.e. there is no chemical reaction between the mixed constituents of each component and all the constituents preserve their structural identity, both during mixing as well as during subsequent storage, and independently of components A' and B'.

According to the present invention, in order to obtain a pasty explosive composition, the component A' and the component B' are then mixed continuously, in such a way that the weight ratio of component A' to component B' is constant (to within industrial standards of accuracy), being between 95.05/4.95 and 99.55/0.45, preferably between 97/3 and 99/1, for example equal to or close to 98/2. This, therefore, allows for optimisation of the composition of the polyurethane matrix.

This continuous mixing of the component A' and the component B' is preferably carried out, for example, in a static mixer, a mixer well known to the person skilled in the art, in the form of a conduit containing braces such as to force the product passing through it to be separated and then remixed.

At the outlet from the mixer, a static mixer or an other mixer inducing low mechanical interaction, in particular inducing a low shear rate, the pasty explosive composition is generally obtained with an output by volume of between 0.1 l/min and 5 l/min, and better still between 0.3 l/min and 1 l/min, for example close to or equal to 0.5 l/min.

With regard to the device, used advantageously for the implementation of the method according to the invention, the following may be specified, without this in any way being limiting.

According to a preferred variant, the components A' and B' are each contained in a vessel (pot), equipped with a piston, the setting in motion of which piston, with the aid of a motor, allows for the feeding with the components A' and B' of a convergent mixing head located upstream of a static mixer, in such a way that the contents of the convergent mixing head pour into the said static mixer.

The pressure on the mixture of the components A' and B' at the convergent mixing head is preferably between 1 MPa and 10 MPa. The two pistons are preferably moved by the same motor.

Taking account of the high weight ratio between component A' and component B', it is interesting to emphasise that such equipment provides the possibility of linking together a plurality of vessels of component A' for the same vessel of component B', without interrupting the continuous process.

The static mixer used preferably comprises a plurality of elements mounted in series, in the form of a conduit, preferably having a diameter of between 15 mm and 60 mm. Use is made, for example, of between 6 and 15 mixing elements, such as those commercially available and well known to the person skilled in the art.

The preferred variant referred to previously, according to which the components A' and B' are each contained in a vessel equipped with a piston, allows for very precise metering and very regular feed delivery, but it is also possible, for example, to feed the static mixer with the aid of metering pumps connected to the storage containers for the components A' and B'.

The static mixer is, in general, provided with a double envelope in order to allow for an adjustment of the temperature.

The vessels or containers containing the components A' and B' can also be provided with a heating system.

According to one preferred variant, the component A' and the component B' are mixed at a temperature of between 40° C. and 80° C.

The pasty explosive composition obtained after mixing the components A' and B' is introduced into a mould, in which it then undergoes thermal cross-linking, in an oven, for example.

This cross-linking results from the formation of urethane bridges arising from the reaction of the hydroxyl functions of the polyol pre-polymer and possibly of the chain-extending compound with the isocyanate functions of the polyisocyanate monomer. The speed of cross-linking increases with the temperature and the catalyst content.

According to one preferred variant, the mould consists of an envelope, in general made of metal, for a munition, such as a shell.

Preferably, and particularly when use is being made of a static mixer to mix the components A' and B' in a continuous manner, the pasty explosive composition emerging from the mixer is introduced in an automated manner into a large series of moulds, such as several hundreds of shell envelopes.

According to one preferred variant of the invention, the temperature of cross-linking of the pasty explosive composition introduced into the moulds is between 15° C. and 80° C.

In particular, it is possible to operate at ambient temperature (about 20° C.), which can be particularly advantageous.

According to one preferred variant, the cross-linking temperature is identical or close to that at which the component A' and the component B' are mixed.

It is now proposed to illustrate the invention and to demonstrate its great interest.

In this context, the example is taken of the manufacture of a composite explosive having the following weight composition:

6.4538% of polyol pre-polymer (PBHT: polybutadiene hydroxy telechelic)

0.7988% of polyisocyanate monomer, cross-linking agent (IPDI: isophorone diisocyanate)

4.3901% of plasticising agent (DOA: dioctyl adipate)

0.0645% of bridging agent (TMP: trimethylolpropane)

0.1171% of antioxidant agent (A02246: 2,2'-methylene-bis-4-methyl-6-tertiobutylphenol)

0.1171% of wetting agent (soybean lecithin)

0.0585% of binder-charge adhesion agent or BCAA (TEPAN: triethylene pentamine acrylonitrile)

0.0001% of catalyst (DBTL: dibutyldilaurate of tin)

88% of charge in powder form (HX: hexogen)

Production takes place successively in accordance with the two-component technique from EP-A-1 333 015 and that of the invention with the weight ratios (A/B, A'/B') of 98/2.

The installation of the Applicant in service at Sorgues comprises two feeder vessels (feeding A or A' and B or B' respectively), each equipped with a piston, feeding (with A or A' and B or B' respectively) a convergent mixing head discharging into a static mixer. At the outlet of the said static mixer, the pasty composition (A+B or A'+B') is tipped into a mould (which can consist directly of the object which is to be loaded).

According to the technique of EP-A-1 333 015, the two components, A and B, have the following respective compositions:

| COMPONENT A | | | COMPONENT B | |
|---|---|---|---|---|
| Pre-polymer | PBHT | 6.4538% | | |
| Bridging agent | TMP | 0.0645% | | |
| | | | Cross-linking agent IPDI | 0.7988% |
| Plasticising agent | DOA | 3.9372% | Plasticising agent DOA | 0.4529% |
| Antioxidant | AO2246 | 0.1171% | | |
| Wetting agent | Lecithin | 0.1171% | | |
| BCAA | TEPAN | 0.0585% | | |
| Catalyst | DBTL | 0.0001% | | |
| Charge | Hexogen | 88.0000% | | |

The component A accordingly has a viscosity of between 2 and $2.5\times10^3$ Pa·s (between 20,000 and 25,000 poises).

In the installation, it is necessary to apply between 2 and $3\times10^6$ Pa (between 20 and 30 bar) of pressure on the pistons in order to attain flows of the order of $21\times10^{-3}$ $m^3/s$ (350 $cm^3/min$).

According to the technique of the invention, the two components A' and B' have the following respective weight compositions:

| COMPONENT A' | | | COMPONENT B' | |
|---|---|---|---|---|
| Pre-polymer | PBHT | 6.4538% | | |
| Bridging agent | TMP | 0.0645% | | |
| Cross-linking agent IPDI | | 0.0400% | Cross-linking agent IPDI | 0.7588% |
| Plasticising agent | DOA | 3.9372% | Plasticising agent DOA | 0.4529% |
| Antioxidant | AO2246 | 0.1171% | | |
| Wetting agent | Lecithin | 0.1171% | | |
| BCAA | TEPAN | 0.0585% | | |
| Catalyst | DBTL | 0.0001% | | |
| Charge | Hexogen | 88.0000% | | |

The component A' comprises 5% of the total quantity of polyisocyanate monomer. The viscosity of the said component A' is therefore between 250 and 300 Pa·s (between 2,500 and 3,000 poises).

In the installation, it is therefore sufficient to apply about $8\times10^5$ Pa (8 bar) of pressure on the pistons in order to obtain flows of the order of $2\times10^{-2}$ $m^3/s$ (350 $cm^3/min$). Flows of about $5\times10^{-2}$ $m^3/s$ (850 $cm^3/min$) are attainable with a pressure of only $2\times10^4$ Pa (20 bar).

In consideration of these figures, the interest in the present invention is clearly manifest.

The invention claimed is:

1. A semi-continuous method for obtaining a composite explosive charge comprising a solid polyurethane matrix loaded with a charge, the method comprising the following successive steps:

continuously mixing a pasty component A' and a liquid component B' to obtain a pasty explosive composition comprising:

a polyol pre-polymer, a polyisocyanate monomer, a plasticising agent, and a solid charge in powder form comprising at least one nitro-organic explosive;

introducing the pasty explosive composition into a mold; and thermally cross-linking the composition in the mold, wherein:

A' and B' are prepared discontinuously from the constituent ingredients, the liquid component B' comprises 90 to 99% by weight of the polyisocyanate monomer, the pasty component A' comprises the whole of the polyol pre-polymer, the whole of the solid charge in powder form and the remaining 1 to 10% by weight of the polyisocyanate monomer, the plasticising agent being distributed without distinction between the components A' and B', and the continuous mixing of the components A' and B' is carried out in such a way that the weight ratio of component A' to component B' is constant, being between 95.05/4.95 and 99.55/0.45.

2. The method according to claim 1, wherein the sum total of the weight contents of polyol pre-polymer, polyisocyanate monomer, plasticising agent, and solid charge in powder form represents between 98% and 100% of the whole of the ingredients.

3. The method according to claim 1, wherein the polyol pre-polymer has a number-average molecular mass (Mn) between 500 and 10,000, and is selected from the group consisting of polyol polyisobutylenes, polyol polybutadienes, polyol polyethers, polyol polyesters and polyol polysiloxanes.

4. The method according to claim 1, wherein the polyisocyanate monomer is selected from the group consisting of toluene diisocyanate, isophorone diisocyanate, dicyclohexylmethylene diisocyanate, hexamethylene diisocyanate, biuret trihexane isocyanate, 3,5,5-trimethyl-1,6-hexamethylene diisocyanate, and mixtures thereof.

5. The method according to claim 1, wherein the pasty explosive composition also comprises at least one additive selected from the group consisting of cross-linking catalysts, wetting agents, antioxidant agents, binder-charge adhesion agents, and chain-extending compounds, the chain-extending compound is totally contained in the component A' and the additive present, other than a chain-extending compound, is distributed without distinction between the two components A' and B'.

6. The method according to claim 5, wherein the at least one additive is totally contained in the component A'.

7. The method according to claim 1, wherein the component B' consists solely of the polyisocyanate monomer.

8. The method according to claim 1, wherein the mixing between the component A' and the component B' takes place in a static mixer.

9. The method according to claim 1, wherein the cross-linking temperature of the pasty explosive composition is between 15° C. and 80° C.

10. The method according to claim 9, wherein the cross-linking temperature of the pasty explosive composition is ambient temperature.

11. The method according to claim 9, wherein the cross-linking temperature of the pasty explosive composition is identical or close to that at which the component A' and the component B' are mixed.

* * * * *